United States Patent [19]

Kromm et al.

[11] 4,085,480

[45] Apr. 25, 1978

[54] DECORATIVE DRAPERY ROD ASSEMBLY

[75] Inventors: David C. Kromm, Finksburg; Henry Znamirowski, Ellicott City, both of Md.

[73] Assignee: Roper Corporation, Kankakee, Ill.

[21] Appl. No.: 759,264

[22] Filed: Jan. 14, 1977

[51] Int. Cl.[2] ..... A47H 1/04; A47H 15/00

[52] U.S. Cl. ..... 16/94 D; 160/38; 160/39

[58] Field of Search ..... 16/94 D, 87.4 R, 95 R, 16/95 D, 96 R, 96 D; 160/19, 38, 39

[56] References Cited

U.S. PATENT DOCUMENTS

| | | | |
|---|---|---|---|
| 3,297,075 | 1/1967 | Howell et al. | 160/38 X |
| 3,463,217 | 8/1969 | Assael | 160/39 |
| 3,983,600 | 10/1976 | Smith | 160/38 |

FOREIGN PATENT DOCUMENTS

| | | | |
|---|---|---|---|
| 1,529,593 | 5/1968 | France | 160/39 |

*Primary Examiner*—Ronald Feldbaum

*Attorney, Agent, or Firm*—Leydig, Voit, Osann, Mayer & Holt, Ltd.

[57] ABSTRACT

A decorative drapery rod assembly including a hollow rod of rectangular section having longitudinal beads and supported upon spaced wall brackets. The rod is nestingly enclosed by a series of decorative plastic modules of channel shape arranged closely end to end, each module having a pair of C-shaped spring clips seated inside the front wall of the module. The spring clips have upper and lower arms for engaging upper and lower surfaces on the rod so that each module may be snapped into a captive forwardly facing position after the rod has been installed in its horizontal working position on the wall, with the modules being slideable endwise on the rod for centering of the series of modules with respect to the rod. In the preferred embodiment the upper arm of each spring clip has a shoulder for engaging one of the beads and a detent spaced therefrom for engaging the other, with the lower arm serving to press the rod relatively upwardly into engagement with the shoulder and detent. The detent is formed in two portions having different spacing with respect to the shoulder thereby to accommodate both the outer and inner sections of a telescoping rod. Modules are preferably furnished in different standard lengths with the end modules having provision for variable overhang, thereby to accommodate rods of any length having supporting brackets in any position. Each spring clip has a central opening which is telescoped over an integral pedestal in the module, the pedestal and opening both being non-circular so that a partial turn of the clip from a condition of register provides a self-threading connection for securely bottoming the clip in place in the module.

11 Claims, 18 Drawing Figures

LOCK

DECORATIVE DRAPERY ROD ASSEMBLY

It has been known in the past to provide a decorative front cover, or fascia, for a traverse type drapery rod, and it has been further known to make the fascia in the form of a series of modules in several standard lengths thereby to accommodate rods in predetermined increments of length.

For example, in Ford U.S. Pat. No. 3,991,435 which issued Nov. 16, 1976 there is disclosed a traverse rod having modules rigidly secured to its front surface, with each module having flanges for lockingly overlapping the adjacent modules. A series of holes or slots are provided in the face of the rod sections at modular intervals. Screws are driven through such holes forwardly from the inside of the rod for engagement with registering holes in the overlapped flanges. The rod must be of a length which is integrally related to the modular length and the modules must be positioned in phase, or register, with the holes in the rod. Since access to the screws is from the back of the rod, the modules must be assembled to the rod with the rod face-down on the floor or on a worktable. The wall brackets are then mounted a specified distance inwardly from the ends of the fascia, and the entire assembly, as a final step, is hoisted into position upon wall brackets. In an alternate construction the fastening screws penetrate the overlapped flanges and thread into registering holes in the rod from the front surface, but in such event the screw heads are visible, requiring that special camouflaging steps be taken. The result, in either event, is that the modular sections are interlocked together end-to-end and fixed rigidly to the traverse rod. A special traverse rod is required in which the inner and outer sections have a row of accurately registrable holes for penetration by the screws, each of which must be inserted through a special "channel protecter" and manually screwed tight. Where modules of several different lengths and designs are used in a series, all of such modules must be integrally related and the assembler must carefully plan ahead in order to achieve left-right symmetry over the length of the rod. Upon making of any miscalculation resulting in lack of symmetry, the series must be partially disassembled by unscrewing certain of the modules and replacing them in a position which is shifted by an integral number of modular lengths. The fact that the modules are fixed to the rod, with a small, rigidly fixed amount of "overhang", makes it impossible to shift a module, or series of modules, gradually or fractionally to achieve intermediate positions. When converting to the conventional fascia system it is not possible to use the same rods since they are not provided with screw holes. It is similarly impossible to lengthen or shorten a rod upon making a change in drapery or decor except in increments of modular length. Indeed, upon making any change in length much of the assembly must be unscrewed to unlock the rod for telescoping movement and then screwed back together again.

It is, in contrast, an object of the present invention to provide a decorative drapery rod assembly including modules of channel shape arranged end to end for nestingly enclosing the rod and which are capable of accommodating a rod of random, infinitely variable length; in other words, the rod need not be limited to standard increments, and with the modules having improved means for engaging the rod so that each module may be snapped into captive relation with the rod after the rod has been installed in horizontal working position on the wall and then adjusted by sliding endwise into final position. The end modules have infinitely variable extension beyond the ends of the rod, conveniently referred to as "variable overhang", and all of the modules are adjustably slideable for centering of the series of modules in a position of symmetry with respect to the rod thereby to equalize the overhang. It is a more specific object to provide a drapery rod assembly in which left and right-hand end modules have provision for extensive cantilevered support upon the ends of the rod, thereby to maintain the end modules in a condition of alignment with the intermediate modules regardless of the degree of overhang.

It is another object to provide a drapery rod assembly in which the rod is enclosed by a series of decorative modules arranged end to end and in which a module may be shifted in position on the rod regardless of the length of the rod, regardless of the location of the rod supporting brackets and regardless of whether the module engages the inner or outer section of a telescoping pair of unlike cross sectional dimension.

It is a more specific object to provide a drapery rod assembly including decorative fascia in the form of a series of standardized modules which may be easily and quickly applied, by snapping into position, after the drapery rod is completely installed in its horizontal working position on the wall and which does not use any separately applied fasteners to secure each module to the rod or to secure the modules to one another. It is a related object to provide a drapery rod assembly having decorative modular fascia in which all of the modules are automatically aligned with one another in forwardly facing position by resilient detenting to form a uniform whole but in which each module is structurally independent from the adjacent modules permitting quick assembly and easy removal and on-the-wall replacement in the event that replacement becomes necessary. Thus it is an object to provide a modular fascia system in which endwise location of each module with respect to the rod is entirely flexible and unrestricted, thereby permitting a rod to be shortened or lengthened, as may be required, even after it is installed and with the only accompanying change being the pulling out, or snapping in, of an individual module, accompanied by slight endwise adjustment of the series of modules, to restore a symmetrical condition.

It is another object to provide a fascia system which does not require the services of a skilled drapery installer, or even detailed written instructions and which may, indeed, be successfully installed by any householder with no previous experience in assembling or installing drapery hardware in but a few minutes' time.

It is yet another object to provide a modular fascia system which uses only a minimum degree of overlap between adjacent modules and in which the overlap may, if desired, be variable or eliminated completely, and which, in any event, does not require the large amount of overlap required, for fastening purposes, in the above-mentioned prior system, thus expanding the design variations and artistic effects available to the designer.

It is still another object of the present invention to provide a drapery rod assembly which is capable of using the standard designs of telescoping and non-telescoping rod without necessity for drilling of a series of holes or performing other modifications to secure the series of modules. Indeed, it is possible, with a slight change in cording provision to utilize rods taken from existing inventory or to use the fascia system on drapery rods already in use, and regardless of existing length, or existing spacing of the supporting brackets, for the purpose of changing room decor.

Other objects and advantages of the invention will become apparent upon reading the attached detailed description and upon reference to the drawings in which.

Figure 2:
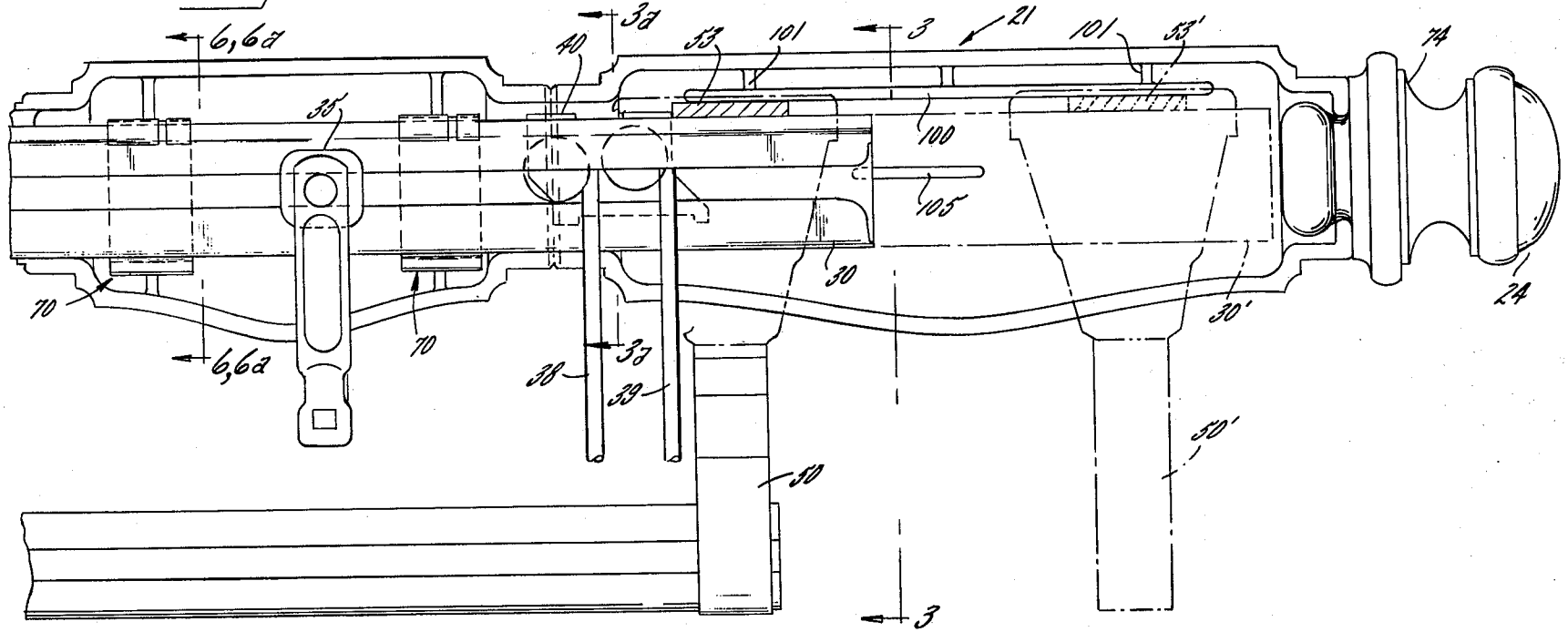
FIG. 2 is a back view of the left-hand end module of the assembly shown in FIG. 1 and showing cantilevered support with variable overhang.
Figures 3, 3A, 4, 7, 8:
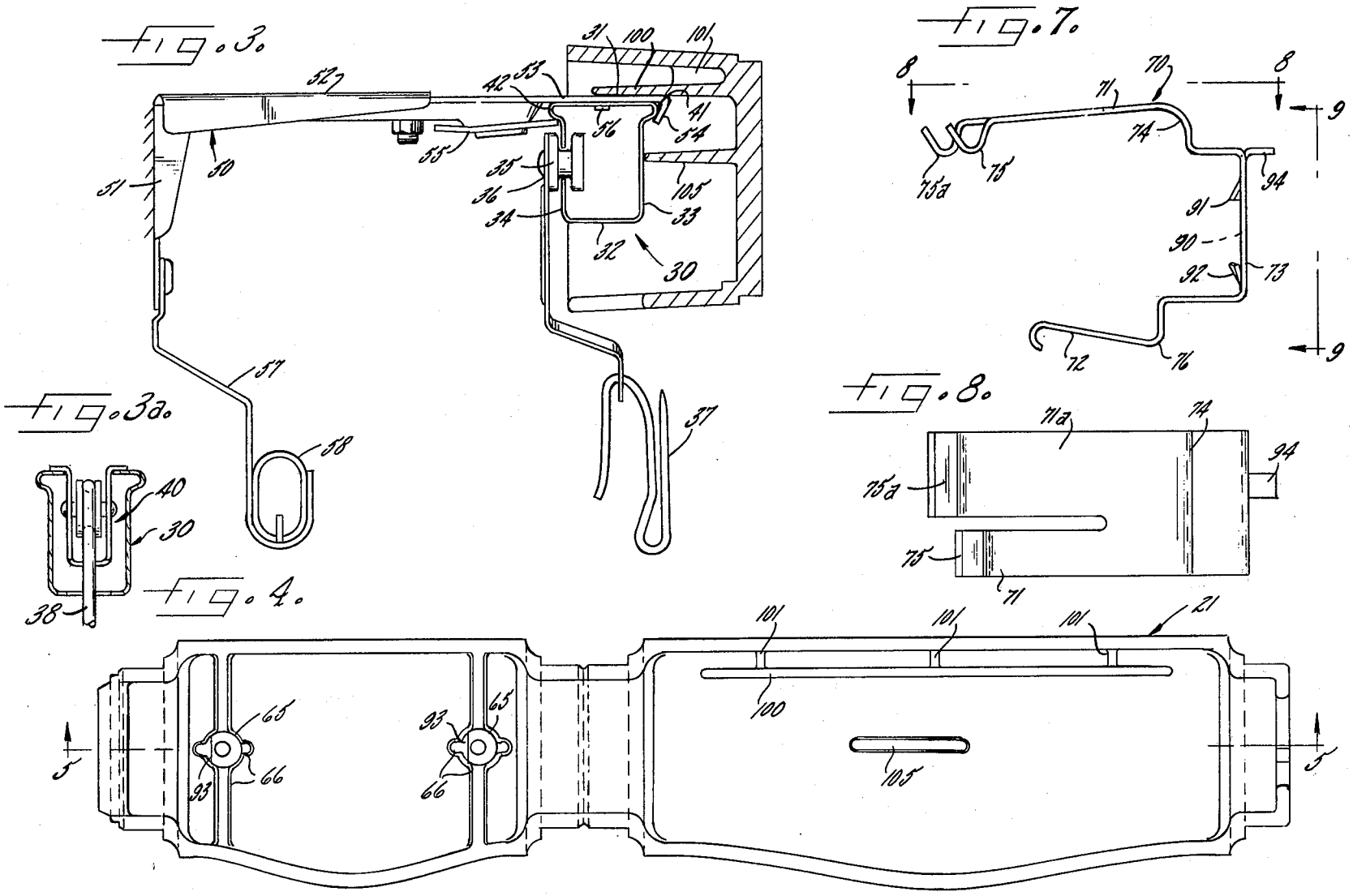

FIGS. 3 and 3*a* are cross sectional views looking along lines 3—3 and 3*a*—3*a* in FIG. 2.

FIG. 4 is a back view similar to FIG. 2 but with the rod removed to reveal the interior construction of the module.

Figure 5:
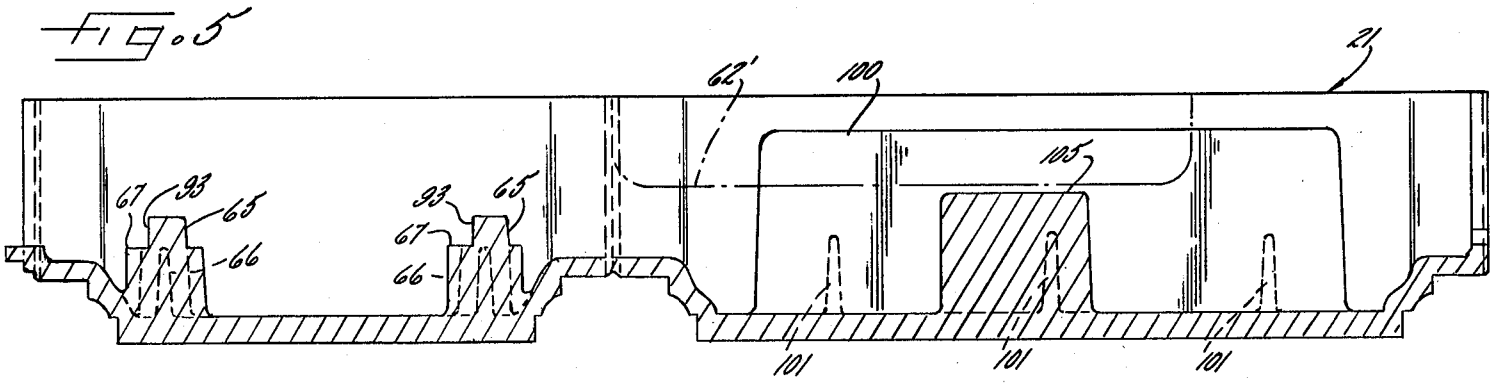

FIG. 5 is a horizontal section looking along the line 5—5 in FIG. 4.

Figure 6A:
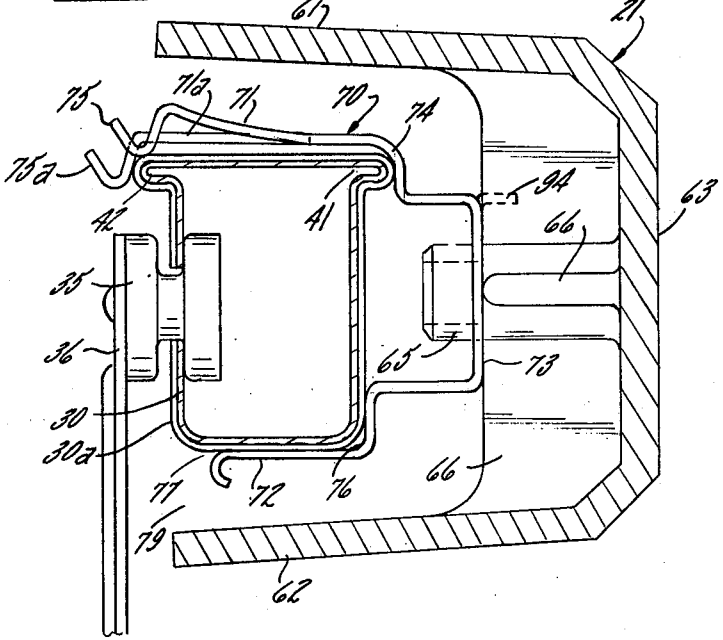
Figure 6:
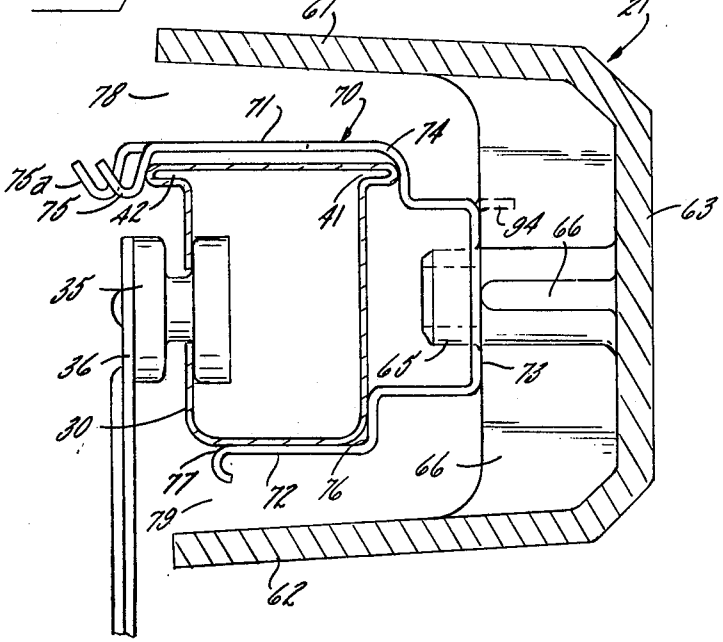

FIG. 6 is a vertical section looking along line 6—6 in FIG. 2 and showing a spring clip engaging the inner section of a telescoping rod.

FIG. 6*a* is a view similar to FIG. 6 but showing the clip in engagement with the outer section of a telescoping rod.

FIG. 7 is a profile view of the spring clip in its relaxed state.

FIG. 8 is a top view of the spring clip shown in FIG. 7.

Figures 9, 10, 11, 12, 13, 13A:
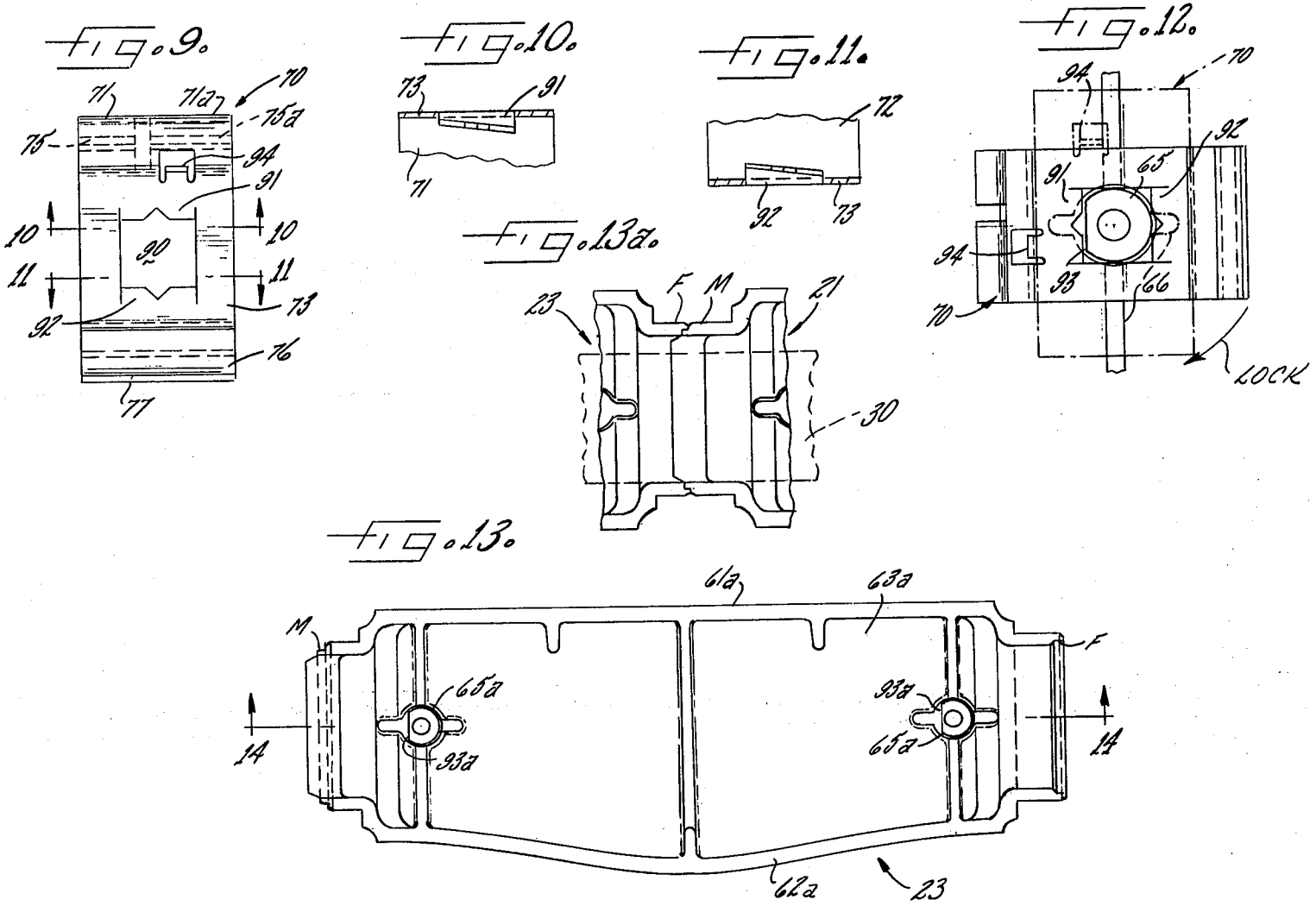

FIG. 9 is the front view of the spring clip of FIG. 7.

FIGS. 10 and 11 are sections taken respectively on lines 10—10 and 11—11 of FIG. 9 and showing the self-threading means for anchoring the clip within its module.

FIG. 12 shows a clip in register with a pedestal and prior to being turned 90° into seated position.

FIG. 13 is a rear view of a minimum or "unit" length module intended to occupy an intermediate position.

FIG. 13*a* is a fragmentary rear view showing the telescoping overlap between adjacent modules.

Figure 14A:
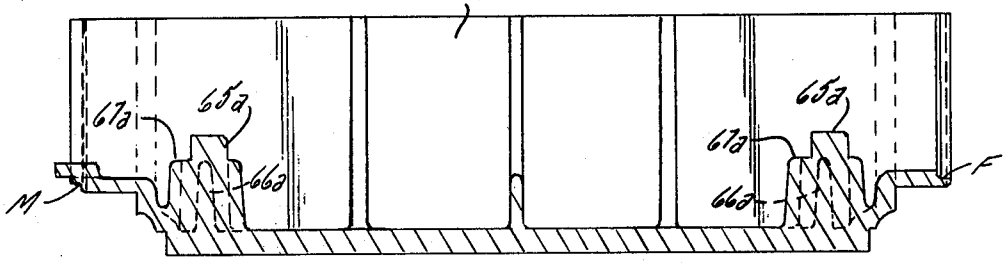

FIG. 14 is a horizontal section taken along the line 14—14 of FIG. 13.

Figure 15A:
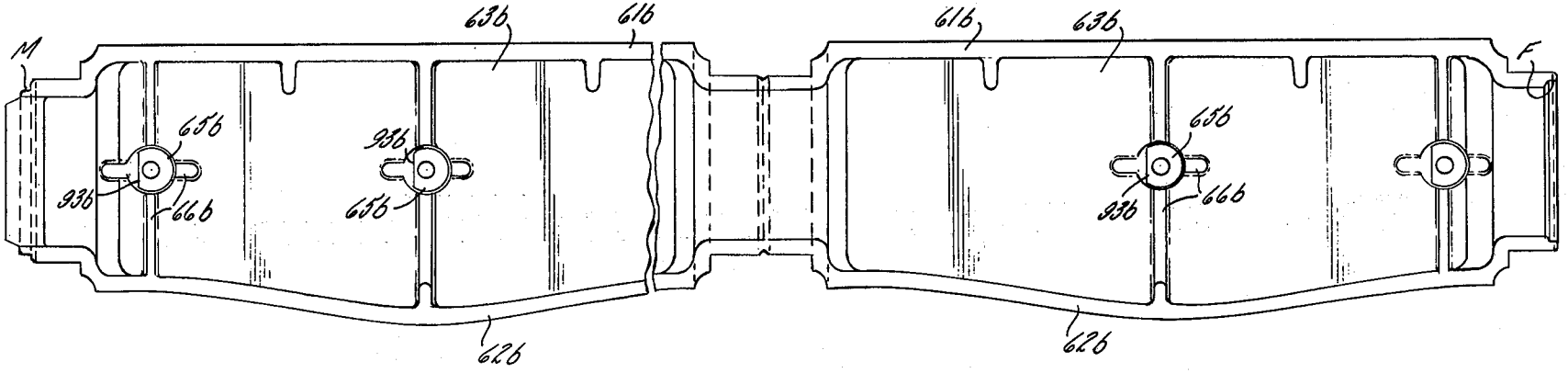

FIG. 15 shows the back view of a double unit module.

While the invention has been described in connection with a preferred embodiment, it will be understood that we do not intend to be limited to the embodiment which has been shown but intend, on the contrary, to cover the alternative and equivalent constructions included within the spirit and scope of the appended claims.

Turning now to a typical drapery rod assembly 20 constructed in accordance with the invention (FIG. 1) it will be seen, in front perspective, to include a left-hand end module 21, a right-hand end module 22 and intermediate modules 23 arranged in a series, stacked closely end to end, to form a repetitive, integrated and symmetrical pattern. The end modules 21, 22 preferably terminate in finials 24 in the form of decorative knobs inserted in openings provided in the end members. The back view of the left-hand end module 21, and the rod upon which it is mounted, are illustrated in FIG. 2 and set forth in cross section in FIG. 3. In the latter figure the rod, indicated at 30, is seen to be of rectangular section having flat top, bottom, and front surfaces 31, 32 and 33, respectively, and a back surface 34 having a longitudinal runner slot 35 occupied by runners 36 which support individual drapery hooks 37. It will be understood that for pulling the drapery open and closed conventional master slides (not shown) are used which are slideable in the runner slot 35 and which are secured to the leading edges of the drapery for movement in opposite directions by draw cords 38, 39 (FIG. 2), the cords being trained about pulleys in a cord guide 40 (FIGS. 3 and 3*a*) internally seated in an aperture spaced inwardly from the end of the rod.

While the rod 30 is of generally rectangular cross section, laterally projecting beads 41, 42 extend along the upper corners, typical of a design of rod in common usage. For the purpose of engaging the beads 41, 42 to support the rod in intermediate as well as end positions, supporting brackets 50 are provided, of which a typical one is illustrated in FIG. 3 and shown profiled by a dot-dash outline in FIG. 2. The bracket 50 has a vertical mounting portion 51 which is conventionally screwed to the wall and a horizontally projecting portion 52 which supports a stirrup 53, the outer end of which is of simple rectangular cross section (FIG. 2) extending flatly over the top surface of the rod. For engaging the beads on the rod, the outer end of the stirrup is bent over to form a hook as shown at 54, and the stirrup, in addition, carries on its underside a known rotatable clamping member, or cam 55, rotatable by a screwdriver or the like, to engage the underside of the adjacent bead. The bracket and stirrup construction is the same in each supporting position, except that in the end positions the stirrup is provided with a downwardly projecting lug 56 (FIG. 3) which engages an opening in the top surface of the rod to hold the rod captive against telescoping movement.

The same brackets 50 which support the rod may be provided with a depending hanger portion 57 for supporting a light gauge curtain rod 58.

Figure 1:
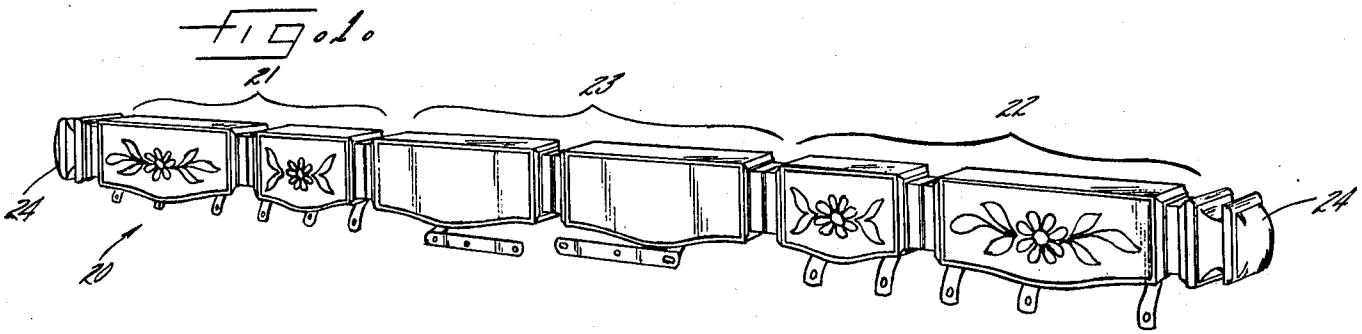
FIG. 1 is a perspective view of a decorative drapery rod assembly constructed in accordance with the present invention.

In accordance with the present invention the series of modules such as shown at 21–23 in FIG. 1, arranged end to end on the rod, are of channel shape having top, bottom and front walls for nestingly enclosing the rod, the modules being provided with C-shaped spring clips seated inside the front wall and having upper and lower arms spaced inwardly from the top and bottom walls respectively. At least one arm of each clip has a detent at its outer end for engaging a bead on the rod, with the remaining arm being opposed to the first arm and so spaced therefrom as to press the rod relatively into engagement with the detent, with the result that each module may be snapped into a captive forwardly-facing position on the rod after the rod has been installed in its operating position on the wall, and with each module having stop means for limiting the degree of relative insertion of the rod so that the front faces of all of the modules are automatically alined in coplanar relation.

Thus, referring to FIGS. 4, 5 and 6, the left-hand end module 21 is in the form of a channel of "C" cross section having a top wall 61, a bottom wall 62, and a front, or presented, wall 63, the bottom wall being notched out along the profile 62' to clear the draw cords. Projecting inwardly from the front wall of the module are spaced pedestals 65 in the form of integral projections, each of which is reinforced by a set of four integral ribs 66, with the rearwardly facing edges of the ribs being aligned to form a seat 67. The projecting portion of each pedestal includes a central opening but such opening is, in the present construction, non-functional. The modules are conveniently and inexpensively molded of polystyrene or similar plastic.

For the purpose of resiliently and captively engaging the rod 30, a spring clip 70 is provided which is of "C" profile having upper and lower spring arms 71, 72 which are spaced inwardly from the upper and lower walls of the module and which are interconnected by an integral base 73. In the preferred construction the upper arm is formed with a shoulder 74 for engaging, and locating, the adjacent bead 41 of the rod and is provided, at its outer end, with a resilient detent 75 for engaging the opposite bead 42 of the rod. The lower arm 72 has a shoulder 76 for engaging the presented lower corner of the rod as well as a free end 77, somewhat foreshortened, for pressing the rod relatively upwardly toward the shoulder 74 and detent 75 on the upper arm.

In accordance with one of the features of the present invention, the spring clip 70 is capable of detented reception of either the inner section 70 of a telescoping rod or the outer section, indicated at **70*a* (FIG. 6*a*) which is telescoped over it. For this purpose the upper spring arm 71 is bifurcated to form a separately flexed spring arm portion 71*a* having a detent 75*a* formed at the end thereof. The spacing between the shoulder 74 and the auxiliary detent 75*a* corresponds to the greater spacing between the beads which exists in the outer section, 30*a*, of the rod, so that the larger cross section may be readily accommodated. When the clip engages the outer section of the rod the inner detent 75 is simply crowded upwardly into an out-of-the-way position. To insure that the detent 75 will, when idle, move to its out-of-the-way position, the arm which carries it (FIG. 8**) is relatively narrower in width and hence quite yieldable.

The shoulders and detents prevent any relative twisting between the modules and the engaged rod; in other words, the clips provide rotational register about a central longitudinally extending axis so that the modules are all held in accurately oriented, forwardly facing positions. The upper and lower arms 71, 72 of the spring clip are spaced inwardly from the top and bottom walls 61, 62 of the module to form clearance spaces 78, 79 (FIG. 6) so that the arms are free to flex upwardly and downwardly without interference from, or bottoming upon, the adjacent wall. Indeed, the upper arm has sufficient flexibility and freedom so that it may flex upwardly to clear a stirrup 53 with which it may happen to be alined or the offending clip can be removed.

In accordance with one of the features of the present invention novel means are provided for attaching each clip to its pedestal. This is accomplished by providing the base 73 of each clip with a non-circular opening and by making the projecting portion of each pedestal of registering noncircular shape, with the presented edges of the opening in the clip being angled to form a screw thread of coarse pitch, so that when the clip is given a partial turn, the edges perform a self-threading operation upon the relatively softer pedestal, causing the clip to be drawn inwardly for firm, bottomed seating against the pedestal seat 67.

Thus, referring to FIGS. 9–12, an opening 90 is provided in the base of the clip with opposite sides of the opening having oppositely angled, inwardly presented edges 91, 92 which are shown in profile in FIGS. 10 and 11 respectively. The projecting portion of the pedestal has a lateral "flat" 93, enabling the pedestal to be freely registered with the opening 90 only when the clip is in a "90°" position, that is, at right angles to its final position. To install a clip upon a pedestal, the clip is manually telescoped over the pedestal in the position illustrated in FIG. 12 and given a 90° turn in the clockwise direction. This causes the angled edges 91, 92 to "bite" into the opposite sides of the pedestal, forming a self-thread thereon, and causing the clip to be propelled endwise in a seating direction incident to its rotation. The pitch or advancement is sufficient so that, incident to only 90° of rotation, the clip is firmly bottomed on the seat portion 67 of the pedestal. To limit angular rotation into seated position, the clip is provided with an integral lug 94 which serves as a limit stop, the lug being obstructed by one of the reinforcing fins 66 forming a part of the pedestal structure. Installation is, therefore, extremely easy and can be accomplished with a minimum of care or skill: the user is simply instructed to insert a clip in the 90° position, so that its opening registers with the pedestal as illustrated in FIG. 12 and to twist it until it can go no further, at which time the clip will be in its desired position profiled by the dot-dash lines in FIG. 12. To disassemble any clip from its position in a module, the procedure is reversed, that is, the clip is simply turned 90° counterlockwise, following which it may be freely withdrawn. The ease of assembly and disassembly makes it possible for clips to be provided in bulk, in a single version only, for completion of each module at the installation site.

In accordance with one of the features of the present invention, the end modules, which are intended to overhang the ends of the rod by an adjustable amount to achieve centering, are provided with auxiliary supporting surfaces. Each supporting surface bears against the top surface of the rod, more particularly against the stirrup which engages such top surface, to provide cantilevered support for the overhanging portion of the module. Such supporting surface is indicated at 100 in FIGS. 2 and 4, the surface being formed on an integral inner wall which extends along the top wall of the module and which, for lightness of construction, is preferably separated from the top wall by means of short ribs 101. The auxiliary supporting surface 100 is effective regardless of whether the amount of overhang is maximum or minimum. Thus FIG. 2, in full lines, shows the condition of maximum overhang, with a rod of minimum length, while the dot-dash lines show use of a rod of maximum length with minimum overhang, the extreme bracket position being indicated at 50'. The range of overhang permitted by the end module is preferably one-half of the length of shortest module used in the system. It will be understood that in the event that the rod is any shorter than the condition illustrated by the full lines in FIG. 2 one of the modules of the series may be omitted; conversely, if the rod is longer than the length indicated by the dot-dash lines in FIG. 2, a module may be added to the series. In both cases, after changing the number of modules, the entire series of modules is easily centered so that the degree of overhang at each end is the same. The range from maximum to minimum in the free end space is repeated and available at increments of one unit module so that rods of infinitely variable length may be accommodated by the present fascia system. Relief 62' (FIG. 5) provides cord clearance throughout the range.

In carrying out the invention, means are provided for insuring equalized insertion of the rod with respect to the modules along the entire length of the series of modules. Thus where the rod is in engagement with the clips, the shoulders 74, 76 serve as locating or stop surfaces. In the case of the end module 21 the depth of insertion of the rod at a position remote from the clips, i.e., in the overhanging portion of the module is limited by a longitudinally extending fin 105 (FIGS. 3–5) which is integrally formed on the inside surface of the front wall of the module. Thus in installing the end module the module is clipped over the rod and the overhanging end portion of the module is simply pushed inwardly until the fin bottoms against the front surface of the rod as illustrated in FIG. 3. The finial 24, preferably having a bayonet type plug connection with the module, may be inserted either after or before the installation of the module 21 upon the rod.

Attention has been thus far focused above on the left-hand end module 21. It will be understood that the right-hand end module 22 (FIG. 1) is constructed identically but in "mirror image" to the module 21. For the construction of typical intermediate modules, reference is made to FIGS. 13 and 15 which show intermediate modules of unit length and double unit length. Considering first the simpler construction of a unit module shown at 23 in FIG. 13, and in horizontal section in FIG. 14, portions of the module are represented by corresponding reference numerals with the addition of subscript *a*. Thus the module includes an upper wall 61*a*, a lower wall 62*a* and a front wall 63*a*. The front wall has integral pedestals 65*a* formed thereon. The projecting portions of the pedestals are, it will be noted, of the same "D" cross section as illustrated in FIGS. 4 and 5, and clips are installed on the pedestals in the same manner as described. It will be noted, as exemplified in FIG. 13 that each module, although of channel shape, has a hollow, relatively enlarged central portion which accommodates the spring clips, and end portions which are necked down to a reduced cross section having an internal dimension only slightly greater than the rod plus stirrup.

Referring next to the intermediate module of double length illustrated in FIG. 15, corresponding elements are indicated by corresponding reference numerals with addition of subscript *b*. Thus the module 60*b* has an upper wall 61*b*, a lower wall 62*b* and a front wall 63*b*, the front wall having integral pedestals 65*b*. In accordance with one of the features of the present invention the pedestals 65*b* in the longer module may be provided in pairs spaced on the order of two inches apart, for use alternatively rather than simultaneously. Thus where one of the pedestals of a pair happens to aline itself with the stirrup of a bracket, the alternate pedestal may be used in its place to insure full detenting action of the clip at the pedestal position.

It will be understood that the advantage of using the double length module illustrated in FIG. 15 as against use of the module of unit length illustrated in FIG. 13, is that only half the number of modules will suffice to fill the intermediate space thereby speeding up assembly of the series.

As a further feature of the present invention, each module is formed to provide an overlapping joint with respect to its adjacent modules to insure that the rod is hidden from view in spite of slight endwise separation of the modules from one another. This is accomplished by forming the opposite ends of the modules, which are of reduced cross section, with shallow male and female terminations as indicated at M and F respectively, the terminations being dimensioned to provide a snug interfit as shown in FIG. 13*a*.

The modular decorative fascia discussed above permits installation in a small fraction of the time required by the conventional modular system which requires assembly of the decorative modules end-to-end on the floor or worktable with the rod inverted thereover and using machine screws to connect each module in phase with holes in the rod. As a final step the entire assembly including the rod and series of modules must be handled and secured as a unit to the brackets. By contrast, using the present system, the rod is secured to the brackets in the usual way, that is, the rod is extended to engage the brackets at the respective ends. After the rod is in place, free operation of all of the slides, master slides and draw cords may be confirmed, and any stickiness corrected, before the decorative fascia modules are added. With the rod in its horizontal working position, the modules 21–23 are snapped one after another into detented positions over the rod and substantially without regard to the bracket and stirrup positions until all the space on the rod is occupied. As stated, simply snapping a module in place automatically insures proper rotational and lateral register, that is, accurate faced alignment of the modules with respect to one another. Each module is slideable endwise after it is snapped in place to insure interfitting at the overlap between modules, and as might be necessary to insure centering of the modules with respect to the rod for equal overhang at each end. That completes the installation.

When converting to the new system it is often practical to use the original rods since no modular series of screw holes are required and any modification will be limited to the roller mount.

In the preferred embodiment of the invention each module is fitted with a pair of clips which are axially spaced from one another. It will be apparent to one skilled in the art, however, that, if desired for the sake of simplicity and minimum cost, a single, centrally located, clip may suffice, particularly if the axial dimension of the clip is increased to provide greater holding power. Also in the preferred form of the invention the upper arm of the clip possesses the detent, but it will be understood that the invention is not limited thereto. A detent may be provided on the lower arm provided the arm does not project sufficiently to interfere with the pendant portion of the carriers or slides. One advantage of making the lower arm short, as shown, is that there is no possibility of such interference. The term "bead" as used herein includes the corners of a rectangular rod where the rod is not equipped with special laterally extending beads such as are illustrated at 41, 42 (FIG. 6). Nor is the invention limited to use with a rod of rectangular section, and the rod may be of round cross section, if desired. Since a round rod has no corners, longitudinal registering beads, for engaging detents on the arms of a spring clip, may be formed, for example, by a rolling operation, on the upper and lower surfaces of the rod. Such beads may be either in the form of a longitudinally extending ridge or a longitudinally extending groove without departing from the invention; however, the invention is preferably practiced using a rectangular rod of the cross section set forth since such rods are already in common use with production facilities available and does not require any modification for use in the inventive combination except to accommodate the cord guide 40.

It is one of the features of the invention that each spring clip includes integral shoulders 74, 76 for location purposes. However, it will be understood that the term "shoulders" as used herein is not limited to locating surfaces which are integral with the clip and such locating surfaces may, instead, be internally molded in the module, just as in the case of the locating fin 105 (FIG. 3).

Also while the clips are preferably of a continuous "C" shape, it will be understood that it is not necessary for the upper and lower arms 71, 72 of a clip to be directly opposed to one another—they may be axially offset from one another if desired as long as balanced forces are applied in the vertical direction to the rod for maintaining a module captive thereon.

Only one design of module is illustrated in the drawings, consisting of alternate regions of enlargement and necking down. However, it will be understood that the invention is not limited thereto and that the possible designs are nearly endless, including variations of wood turnings with simulated grain. The invention may be readily adapted to almost any period or style of decoration.

The slight telescoped overlap between modules not only prevents direct sighting of the rod, which would destroy the illusion of continuity, but it also insures precise axial alignment, notwithstanding production variations in the spring clips. For example where two clips are used side by side in the same module they may act differentially tending to produce slight cocking of an individual module. Any such tendency is completely corrected by the interfit between modules. The overlap is nevertheless sufficiently shallow as to enable any one of the modules to be removed and replaced, should one of them become damaged, without necessity for taking down the entire rod. For removal, the rest of the modules of the series may be temporarily crowded endwise to provide clearance, and, when the new module has been substituted, the space is simply redistributed.

Similar flexibility is provided whenever it is desired to change the decor by either increasing or decreasing the drapery width: The end brackets are remounted to the wall at the new spacing, accompanied by slight telescoping of the rod sections, removal or addition of modules as required, and recentering of the series by endwise sliding adjustment. Also incident to change in decor, the system permits substitution of an entirely different module design by removal of one set of modules and snapping another set in place without removal or adjustment of the rod itself. Since the particular illustrated design of rectangular rod is in such common usage, and since only slight modification is required in order to practice the invention, it will be apparent that the present fascia system has a wide application to rods already in operation and which have been in use for a period of years.

The term "snapping" has been used herein to graphically describe the detent action and, indeed, the advantage of a relatively "sharp" detent is that it signals to the user, by sense of feel if not hearing, that a module has been captively seated. However, it will be understood that the invention is not limited thereto and, because of the use of positive stops to limit insertion, the detenting may be "soft" and the grip entirely frictional without sacrificing the main features and advantages of the invention.

The term "slideable" has been used to describe the capability of the modules; whether the slideability is free or stiff will, of course, depend upon the stiffness of the spring clips, and thus the significance of the term is that the modules have capability of endwise adjusting movement for centering the series to achieve equalized overhang independently of rod length.

Moreover, the term "spring clip" has been used for convenience, such clip having at least one spring "arm". It will be understood that the terms "clip" and "arm" are not necessarily limited to the specific construction shown, and it will be apparent to one skilled in the art that other spring elements, and shapes thereof, can be employed to achieve the function of registered captivity. In this connection, while it is greatly preferred to employ a spring clip of "C" shape which is anchored, at its center, to the inside of the front wall of the module, it will also be apparent to one skilled in the art that the invention may be used, in its broader aspect, with different specific mountings so that the term seated "inside" of the front wall does not necessarily require that the clip be actually supported upon the front wall.

Similarly, while the invention has been described in connection with a conventional bracket 50 and stirrup 53 (FIG. 3), it will be understood that the invention may be practiced with any wall bracket and that the term "stirrup" as used herein refers to any means for securing the bracket to the rod and which does not interfere with the nesting of the rod in the modules.

In the embodiment of the invention described above modules are used which are of unit length and low order multiples of unit length. While it is desirable to standardize on integral low ratios, this is not one of the requirements of the invention. The invention is, however, directed toward use of modules in a repetitive or "building block" pattern for maximum economy and with the order of the modules preferably being symmetrical, or balanced, so as to be pleasing to the eye.

Notwithstanding the impression of richness imparted by the disclosed fascia system, particularly where the modules have expensive wood graining, or appear to be intricately carved, it will be apparent to one skilled in the art that the modules may be manufactured by quantity production molding methods permitting use in even the most economical decorating schemes.

In the preferred embodiment the modules have full top and bottom walls for nestingly receiving the rod to insure a three dimensional effect. However, it will be understood that the top wall may, for reasons of economy, be substantially foreshortened with respect to the bottom wall in the in-out or "depth" direction, where such foreshortening cannot be detected at normal viewing angles, without departing from the invention, and the term "of channel shape" shall be understood to include this possibility.

What is claimed is:

1. A decorative drapery rod assembly comprising, in combination, a hollow rod of rectangular shape formed of partially telescoped inner and outer sections having laterally projecting beads extending along the top corners and a runner slot extending along the back surface, spaced wall brackets having stirrups projecting over the top surface of the rod for lockingly engaging the beads thereby to support the rod in horizontal working position, a series of decorative modules of channel shape fitted end to end in a repetitive pattern to provide an illusion of solid continuity and having top, bottom and front walls for nestingly enclosing the rod, each module having a pair of C-shaped spring clips spaced therein, the spring clips being seated inside the front wall and having upper and lower arms spaced inwardly from the top and bottom walls respectively, the spring clips being dimensioned to accommodate both the inner and outer sections of the rod, the upper arm of each spring clip having an associated shoulder for engaging one of the beads and having a detent spaced therefrom for engaging the other bead, the lower arm underlying the rod and serving to press the rod relatively upwardly into engagement with the shoulder and detent so that each module may be horizontally snapped into a captive forwardly-facing position on the rod after the rod has been installed in its horizontal working position on the wall, the detent presenting a surface enabling easy snapping on and off the rod, the modules being individually slideable endwise on the rod for centering of the series of modules with respect to the rod.

2. A decorative drapery rod assembly comprising, in combination, a hollow rod of rectangular shape formed of partially telescoped inner and outer sections having a runner slot extending along the back and having at least one longitudinally extending bead, spaced wall brackets having flat stirrups for supporting the rod in horizontal working position, a series of decorative modules of channel shape fitted end to end in a repetitive pattern to provide an illusion of solid continuity and having top, bottom and front walls for nestingly enclosing the rod, each module having a pair of C-shaped spring clips spaced therein, the spring clips being seated on the front wall and having first and second arms forming a receptacle and spaced inwardly from the top and bottom walls, the first arm of each spring clip having a detent at its outer end for engaging the bead, the spring clips being dimensioned to accommodate both the inner and outer sections of the rod, the second arm being opposed to the first arm and so spaced therefrom as to press the rod relatively into engagement with the detent on the first arm with the result that each module may be horizontally snapped into a captive forwardly-facing position on the rod after the rod has been installed in its operating position on the wall, the detent presenting a surface enabling easy snapping on and off the rod, each module having stop means associated with the clips for limiting the degree of relative insertion of the rod into the module so that the front walls of all of the modules are aligned in coplanar relation.

3. A decorative drapery rod assembly comprising, in combination, a hollow telescoping rod having inner and outer extensible sections, with aligned runner slots extending along the back surface, spaced wall brackets having flat stirrups projecting over the top surface of the rod for supporting the sections of the rod partially telescoped into a horizontal working position, a series of decorative modules of channel shape fitted end to end to provide an illusion of solid continuity and having top, bottom and front walls for nestingly enclosing the rod, each module having a pair of C-shaped spring clips spaced therein, the spring clips being seated inside the front wall and having upper and lower arms spaced inwardly from the top and bottom walls respectively, the spring clips being shaped and dimensioned to horizontally snap over and resiliently accommodate either the inner or outer rod section so that the rod is captively nested with all of the modules in forwardly facing position but with the modules being thereafter individually slideable endwise on the rod for centering of the series of modules with respect to the rod, the series of modules including end modules extending substantially beyond the ends of the rod to provide overhang, and supporting means in the end modules engaging the rod for cantilevered support of the overhang.

4. A decorative drapery rod assembly comprising, in combination, a hollow rod having a longitudinally extending bead and a runner slot extending along the back surface, spaced wall brackets having stirrups for supporting the rod in horizontal position, a series of decorative modules of channel shape arranged closely end to end in a repetitive pattern and having top, bottom and front walls for enclosing the rod, each module having at least one C-shaped spring clip, the inside surface of the front wall being formed with an integral pedestal for supporting the spring clip, the pedestal being of non-circular cross section, the pedestal engaging the central portion of the clip, the spring clip being shaped and dimensioned to be snapped over the rod with the rod in its horizontal working position, means on the spring clip of each module for engaging the bead on the rod for holding all of the modules in aligned forwardly facing positions, while permitting endwise centering movement thereof, the clip of each module having means for threadedly engaging the pedestal thereby to provide engageable and disengageable attachment of the clip to its pedestal.

5. A decorative drapery rod assembly comprising, in combination, a hollow rod having a runner slot extending along the back surface thereof, spaced wall brackets having stirrups for supporting the rod in a horizontal position, a series of decorative modules of channel shape arranged closely end to end in a repetitive pattern, and having top, bottom and front walls for enclosing the rod, each module having at least one C-shaped spring clip, the inside surface of the front wall of each module having a pedestal including a projection having a non-circular cross section and an adjacent shoulder, the spring clip having a central opening defined by angled edges and of registering non-circular shape, and the projection being formed of relatively soft plastic, so that when the clip is telescoped over the projection in register therewith and given a partial turn the clip is self-threadingly engaged with the projection thereby forming the clip into seated position on the shoulder.

6. The combination as claimed in claim 5 in which the opening in the clip has opposed edges which are angled with respect to one another so that when the clip is given a partial turn the angled edges bite into the walls of the projection to propel the clip into a firmly seated position on the shoulder, and means for blocking rotation of the clip at a desired orientation.

7. A decorative drapery rod assembly comprising, in combination, a hollow rod consisting of two telescoping sections of mating rectangular section having laterally projecting beads extending along the top corners and a runner slot extending along the back surface, spaced wall brackets having stirrups projecting over the top surface of the rod for lockingly engaging the beads thereby to support the rod in horizontal working position, a series of decorative modules of channel shape fitted end to end in a repetitive pattern to provide an illusion of solid continuity and having top, bottom and front walls for enclosing the rod, each module having at least one spring clip seated inside the front wall thereof and including an upper arm spaced inwardly from the top wall, the upper arm having a shoulder for engaging the adjacent bead on the rod and having first and second spring detents at its free end, the detents being spaced from the shoulder by differing amounts corresponding to the spacing between the beads of the inner and outer sections of the rod so that the spring clip is capable of detented accommodation of both of the sections.

8. A decorative drapery rod assembly comprising, in combination, a hollow rod of rectangular cross section having telescoping inner and outer sections, the rod being formed with laterally projecting beads extending along the top corners and a runner slot extending along the back surface, spaced wall brackets having flat stirrups projecting over the top surface of the rod for lockingly engaging the beads thereby to support the rod in horizontal working position, a series of decorative modules of channel shape fitted end to end overhanging the ends of the rod and having top, bottom, and front walls for enclosing the rod, each module having a pair of readily engaged and disengaged C-shaped spring clips spaced therein, means for seating the spring clips inside of the front wall so as to define upper and lower spring arms spaced inwardly from the top and bottom walls respectively, the upper arm of each spring clip having a shoulder for engaging the adjacent one of the beads and having detent means at its end for engaging the other bead, the lower arm of the clip underlying the rod and serving to press the rod relatively upwardly into engagement with the shoulder and detent means so that each module may be snapped into a captive forwardly facing position with the rod installed in horizontal operating position on the wall, the modules being slideable endwise on the rod for centering of the series of modules with respect to the rod for equal overhang at the opposite ends, the upper arm of the spring clip being bifurcated with each of the bifurcations having a detent at the end thereof respectively spaced from the shoulder to correspond to the bead spacing of the inner and outer telescoping sections of the rod so that each module is capable of use at any position along the length of the rod.

9. A decorative drapery rod assembly comprising, in combination, a hollow rod having a runner slot extending along the back surface thereof, spaced wall brackets having stirrups for supporting the rod in a horizontal position, a series of decorative modules of channel shape arranged closely end to end in a repetitive symmetrical pattern, each module having top, bottom and front walls for enclosing the rod, each module having internal attachment means nested therein for captively engaging the upper and lower surfaces of the rod, stop means inside the front wall of each module for bottoming against the front surface of the rod thereby to limit the degree of relative insertion of the rod into the module, the stop means being so located in each of the modules that the front walls of the modules are, upon engagement with the rod, automatically aligned in coplanar relationship with one another, and the modules in the series having male and female connections at the opposite ends thereof to form a telescoped overlapping connection between adjacent modules so that adjacent modules are maintained in alignment with one another notwithstanding minor variations in the spring clips of the individual modules.

10. The combination as claimed in claim 9 in which the series of modules includes relatively long left and right-hand end modules which are mirror images of one another with a plurality of intermediate modules arranged end to end occupying all of the space in between including at least one module of relatively short unit length and modules having a low order multiple of unit length, the attachment means in the end modules being located at the respective inner ends, the end modules having free space in their outer ends to accommodate a variable degree of overhang of the end modules with respect to the ends of the rod, the length of the free space being at least one-half of the length of the unit module so that rods having infinitely variable length may be completely accommodated in the series of modules by the addition to or subtraction of a unit module from the series followed by centering of the series to equalize the overhang, the overhang portion at each end module including an auxiliary internal supporting surface for engaging the top surface of the rod to provide cantilevered support.

11. The combination as claimed in claim 9 in which the series of modules includes relatively long left and right-hand end modules which are mirror images of one another with a plurality of intermediate modules arranged end to end occupying the space in between including at least one module of relatively short unit length, the attachment means in the end modules being located at their respective inner ends, the end modules having free space in their outer ends to accommodate a variable degree of overhang of the end modules with respect to the ends of the rod cords in the rod, the rod being apertured inwardly of its end and having a cord guide seated in the aperture for exit of the cords downwardly therefrom, the lower walls of the end modules being relieved to accommodate passage of the cords notwithstanding variation in the degree of overhang of the end modules beyond the ends of the rod.

* * * * *